US005468311A

United States Patent [19]

Godsey et al.

[11] Patent Number: 5,468,311

[45] Date of Patent: Nov. 21, 1995

[54] BINDER SYSTEM FOR CROSSLINKED DOUBLE BASE PROPELLANT

[75] Inventors: James H. Godsey; James L. Jacox; Robert F. Keller, all of Salt Lake City, Utah; Richard J. Legare, Conyers, Ga.

[73] Assignee: Hercules Incorporated, Wilmington, Del.

[21] Appl. No.: 22,123

[22] Filed: Mar. 5, 1979

[51] Int. Cl.[6] ..... C06B 49/10

[52] U.S. Cl. ..... 149/19.4; 149/19.8

[58] Field of Search ..... 149/19.4, 19.8, 149/94–100

[56] References Cited

U.S. PATENT DOCUMENTS

| | | | |
|---|---|---|---|
| 3,711,344 | 1/1973 | Pierce | 149/19.8 |
| 3,956,890 | 5/1976 | Davis | 149/19.8 |
| 3,994,946 | 11/1976 | Dunigan et al. | 149/98 |
| 4,011,114 | 3/1977 | Allabashi | 149/98 |
| 4,072,546 | 2/1978 | Winer | 149/96 |
| 4,645,261 | 2/1987 | Baczuk | 149/100 |

*Primary Examiner*—Edward A. Miller
*Attorney, Agent, or Firm*—Mark Goldberg

[57] ABSTRACT

An improved crosslinked double base propellant composition is provided which has an improved binder system. The binder system is based on nitrocellulose (NC) having an intrinsic viscosity of from about 0.4 dl./gram to about 1.5 dl./gram and a polyester polyol or polyether polyol (polyol), in which the weight ratio of NC/polyol is from about 0.03/1 to about 0.8/1. The binder crosslinking agents are diisocyanates, and the ratio of NCO groups of the diisocyanates to combined OH groups of nitrocellulose and polyol is from about 0.7/1 to 1.2/1. Energetic plasticizer such as nitroglycerin comprises from about 68% to about 82% by weight of the binder. The binder contains a stabilizer and is capable of high solids loading, i.e., 70% to 77% solids.

7 Claims, No Drawings

BINDER SYSTEM FOR CROSSLINKED DOUBLE BASE PROPELLANT

The U.S. Government has a paid-up license in this invention and the right in limited circumstances to require the patent owner to license others on reasonable terms as provided by the terms of Contract No. N00030-74-C-0100 awarded by the Department of the Navy.

This invention relates to high performance crosslinked double base propellant compositions. More particularly, this invention relates to high performance crosslinked double base propellant compositions having an improved binder system which imparts improved propellant mechanical properties, reliability and safety without detriment to the ballistic performance of the propellant composition.

BACKGROUND OF THE INVENTION

Solid propellants currently used in strategic missiles are either of the double base or composite type. Both types of propellant are performance limited due in part to limits on processability of the propellant compositions. Composite propellants rely on a high solids content (88–90%) while conventional double base propellants rely on a combination of rather low solids (about 50%) and an energetic binder for maintaining high performance levels.

Crosslinked double base propellant has also been investigated for use in strategic missiles. One type of crosslinked double base propellant based on the use of plastisol nitrocellulose and an isocyanate terminated prepolymer to form the propellant binder is disclosed in U.S. Pat. No. 3,798,090. This type propellant has been performance limited because of processing problems associated with the use of plastisol nitrocellulose as the nitrocellulose source.

Another type of crosslinked double base propellant is disclosed in U.S. Pat. No. 3,956,890. This propellant employs lacquer grade nitrocellulose in the binder. This propellant does not have adequate mechanical properties or specific impulse to meet performance requirements for strategic missiles.

It is an object of this invention to provide propellant compositions having improved mechanical, ballistic and processing properties suitable for use in high performance strategic missile systems.

It is another object of this invention to provide propellant compositions having improved thermal stability and long term storage stability.

It is another object of this invention to provide an improved binder system for crosslinked double base propellant compositions.

These and other objects of the invention will be apparent from the description and examples which follow.

In accordance with this invention, an improved crosslinked double base propellant composition is provided, the improvement comprising a binder system consisting essentially of nitrocellulose having an intrinsic viscosity of from about 0.4 deciliters/gram to about 1.5 deciliters/gram, an aliphatic diisocyanate, a polyester polyol or polyether polyol, an energetic nitrate ester plasticizer and a binder stabilizer. The weight ratio of nitrocellulose to the polyol is from about 0.03/1 to about 0.8/1. The ratio of NCO groups of the diisocyanate to the combined hydroxyl groups of nitrocellulose and the polyol is from about 0.7/1 to about 1.2/1. The energetic nitrate ester plasticizer comprises from about 68% to about 82% by weight of the binder composition and the weight ratio of plasticizer (including stabilizers therefor) to polymer (nitrocellulose+polyol+binder stabilizer+crosslinking agent) is from about 2.1/1 to about 4.5/1. The binder system comprises from about 23% to about 30% by weight of the improved propellant composition. A binder stabilizer is employed in an amount of from about 0.4% to about 1.0% by weight of the propellant composition.

The nitrocellulose which can be employed in the propellant of this invention has an intrinsic viscosity of at least about 0.40 deciliters/gram and a calculated molecular weight range of from about 14,000 to about 68,000. Nitrocellulose which can be employed in the improved propellant of this invention is described in Table I. The preferred nitrocellulose has an intrinsic viscosity of 0.4 dl./gram, a molecular weight of about 14,000 and contains 12% by weight of nitrogen.

TABLE I(U)

| Nitrocellulose Type[1] | Approx. Nitrogen (Wt. %) | Calculated Molecular Weight[2] | Approx. Intrinsic Viscosity[3] dl/gram | Solution Viscosity[4] (seconds) |
|---|---|---|---|---|
| RS 18–25 cps | 12.0 | 14,000 | 0.40 | 18–25 cps (12.2% soln.) |
| RS ¼ sec. | 12.0 | 22,000 | 0.55 | 4–5 sec. (25% soln.) |
| RS ½ sec. | 12.0 | 33,000 | 0.72 | 3–4 sec. (20% soln.) |
| RS ¾ sec. | 12.0 | 42,000 | 0.88 | 6–8 sec. (20% soln.) |
| RS 5–6 sec. | 12.0 | 68,000 | 1.47 | 5–6.5 sec. (12.2% soln.) |
| SS ¼ sec. | 11.0 | 22,000 | 0.55 | 4–5 sec. (25% soln.) |
| SS ½ sec. | 11.0 | 33,000 | 0.72 | 3–4 sec. (20% soln.) |
| SS 5–6 sec. | 11.0 | 42,000 | 1.47 | 5–6.5 sec. (12.2% soln.) |
| AS ½ sec. | 11.5 | — | — | 5–6.5 sec. (12.7% soln.) |

[1]RS, SS and AS type designations for nitrocellulose specifically refer to designations used by Hercules Incorporated for nitrocellulose grades sold by Hercules Incorporated. An "RS" type nitrocellulose indicates solubility of the nitrocellulose in esters such as ethyl and butyl acetates, in ketones and glycol ethers. An "SS" type nitrocellulose indicates solubility of the nitrocellulose in mixtures of alcohol and toluene. An "AS" type nitrocellulose is desirable when alcohol rather than hydrocarbon is used as diluent. See "Nitrocellulose, Properties and Uses", Hercules Powder Company, (1955), particularly pages 8–12.

[2]Molecular weight calculated from intrinsic viscosity values. See article entitled "Intrinsic Viscosity of Nitrocellulose", C. H. Lindsley and M. B. Frank, Industrial and Engineering Chemistry, November 1953, pp. 2491–2497.

[3]Intrinsic Viscosity determined using acetone solvent.

[4]Solution viscosity is measured by the Falling Ball Method using as the solvent a mixture comprising by weight, 20% ethyl acetate, 25% denatured ethyl alcohol and 55% toluene.

The aliphatic diisocyanate crosslinking agents employed in the propellant composition of this invention include, without limitation, hexamethylene diisocyanate, lysine diisocyanate, isophorone diisocyanate, and the like. The preferred aliphatic diisocyanate crosslinking agent is hexamethylene diisocyanate.

Energetic plasticizers employed in the propellant compositions of this invention are nitrate esters. The most commonly employed energetic nitrate ester plasticizer is nitroglycerin. Other energetic nitrate ester plasticizers which can be employed include, without limitation, trimethylolethane trinitrate, diethyleneglycol dinitrate, triethylene glycol dinitrate, butanetriol trinitrate, and the like.

The polyols employed in the propellant compositions of this invention may be polyesters or polyethers having molecular weights of from about 400 to about 4000 and hydroxyl functionalities of from about 2.0 to about 2.8. The polyesters useful in the composition of this invention can be prepared by the condensation reaction between one or more polyhydric alcohols and one or more dibasic carboxylic acids or anhydrides thereof. The ratio of polyhydric alcohol to dibasic carboxylic acid should be controlled so that there is an excess of hydroxyl groups. Polyesters having molecular weights from about 2000 to about 3000 are preferred in this invention. Illustrative polyhydric alcohols employed in preparation of the polyesters include polyethylene glycol, diethylene glycol, ethylene glycol, and the like.

Any dibasic carboxylic acid or its anhydride can be used in the preparation of the polyester polyols. Illustrative dibasic carboxylic acids and anhydrides include adipic, sebacic, malonic, suberic, succinic, maleic, fumaric and itaconic acids and anhydrides. The preferred polyesters are prepared by reacting adipic acid with ethylene glycol, propylene glycol, diethylene glycol, polyethylene glycol, polypropylene glycol, and/or butylene glycol, the glycols being used singly or in mixtures of two or more to give polyesters having molecular weight ranging from about 500 to 3500 and preferably from about 2000 to 3000. The preferred polyol is polyethylene glycol adipate.

Polyether polyols are the condensation products of a polyhydric alcohol and one or more alkylene oxide units having 2–4 carbon atoms such as ethylene oxide, propylene oxide and butylene oxide. Polyether polyols are prepared by the addition or sequential addition of ethylene oxide, propylene oxide, butylene oxide or mixtures thereof to a polyhydric alcohol base. Polyhydric alcohols described above for use in preparation of polyesters can be employed in the preparation of polyether polyols.

(C) Crosslinked double base propellants are subject to degradation with time as a result, in part, of hydrolysis of the polymeric binder backbone by humidity and by acid formed from degradation of the nitrate ester plasticizer. Therefore, crosslinked double base propellants contain stabilizers to reduce the effects of such degradation. The crosslinked double base propellant of this invention contains a stabilizer in order that the properties of the propellant resulting from the improved binder system of this invention do not degrade quickly with time. The preferred stabilizers for crosslinked composite modified double base propellant stabilize by a nitrosation reaction rather than by nitration reaction. Examples of preferred stabilizers are N-methyl-p-nitroaniline (MNA); N-isopropyl-p-nitroaniline; N-(2-acetoxyethyl)-p-nitroaniline; N-(2-methoxyethyl)-p-nitroaniline; N-(2,2-dimethoxyethyl)-p-nitroaniline; and the like. Other stabilizer which can be employed include 1,3-bis(N-m-methoxyphenylurethane)benzene (BMUB); 1,3-bis-(N-m-tolylurethane)benzene; 1,3-bis(N-m-chlorophenylurethane)benzene; 1,3-bis(N-m-phenylurethane)benzene; 1,3-bis(N-ethylurethane)benzene; bis(m-methoxyphenyl)urethane; and the like. Stabilizers are employed in amount of from about 0.4% to about 1.0% by weight based on the weight of the propellant composition, or from about 1.3% to about 4.3% by weight, based on the weight of the binder system.

The propellant compositions of this invention can contain solids levels of from 70% to 77% by weight. The solids are various oxidizers and fuels which are formulated to provide the proper stoichiometry for complete combustion and high performance. From a performance standpoint it is desirable to maximize the solid level in the propellant composition of this invention. However, mechanical properties of propellants suffer as the solids level increases. It is necessary to maintain the solids level at or below about 77% by weight and the solids are preferably from about 70% to about 75% by weight of the propellant composition.

The improved propellant composition of this invention is more fully illustrated hereinafter. In the examples and tables of data which follow and throughout the specification, percentages are by weight unless otherwise specified.

Example 1

Crosslinked double base propellant compositions of this invention are prepared as described herein. In the process described the polyester polyol is polyglycol adipate and the nitrate ester employed is nitroglycerin, it being understood that other polyester polyols and polyether polyols can be substituted for polyglycol adipate and other liquid nitrate esters can be substituted for nitroglycerin following the same mixing procedures as described.

A binder premix is prepared by dissolving nitrocellulose and stabilizers therefor in a mixture of polyglycol adipate and nitroglycerin. The nitroglycerin mixture employed in the binder premix comprises 99% by weight nitroglycerin and 1% by weight of 2-nitrodiphenylamine stabilizer. The resulting binder premix solution is dry air sparged for about 24 hours at up to 150° F. (maximum) to remove volatiles and alcohol and water and to complete mixing of the binder premix solution. The binder premix solution is transferred to a mixing bowl and solid ingredients such as particulate ammonium perchlorate, aluminum and cyclotetramethylenetetranitramine (HMX) are added to the mixing bowl containing the binder premix solution. The resulting propellant mass is mixed under vacuum (~10 mm Hg) for a time sufficient to assure thorough dispersion of the solids throughout the liquid binder premix and to remove volatile materials. Mixing under vacuum continues for approximately 1.25 hours. A curing catalyst and curing agent are added to the resulting propellant mass and a second vacuum mix cycle is begun. The second vacuum mix cycle (~0 mm Hg) lasts for about 30 minutes. After this mixing step, the uncured propellant compostion (slurry) is cast into a suitable mold or motor chamber and is cured for from 5–7 days at about 120° F. The propellant compositions set forth in Table II were prepared following the processing procedure described above and were tested. The propellant compositions and their mechanical properties, thermal stability, processability and ballistic properties are set forth in Table II.

TABLE II (C)

| PROPELLANT COMPOSITIONS AND PROPERTIES | | | | | | |
|---|---|---|---|---|---|---|
| Example No. | 2 | 3 | 4 | 5 | 6 | 7 |
| Composition (%) | | | | | | |
| Binder premix | 22.58 | 29.11 | 22.47 | 24.62 | 24.65 | 29.10 |
| Solids; aluminum, ammonium perchlorate (AP), cyclotetramethylene tetranitramine (HMX) | 77.00 | 70.00 | 77.00 | 75.00 | 75.00 | 70.00 |
| Hexamethylene diisocyanate (HDI) | 0.42 | 0.89 | 0.53 | 0.38 | 0.35 | 0.88 |
| Dibutyl tin diacetate (DBDTA) | 0.0012 | — | 0.0008 | 0.0007 | 0.0004 | — |
| Triphenyl bismuth (TPB) | — | 0.0060 | — | | | 0.0060 |
| Isocyanate functionality (NCO) to hydroxyl functionality ratio, (NCO/OH) | 0.79 | 0.85 | 0.62 | 0.47 | 0.43 | 0.84 |
| Binder Premix Description | | | | | | |
| Nitrocellulose to polyglycol adipate ratio (NC/PGA) | 0.50 | 0.25 | 0.46 | 0.80 | 0.80 | 0.25 |
| Plasticizer (Ng) to polymer ratio | 5.0 | 2.2 | 2.7 | 4.1 | 4.1 | 2.4 |
| 2-nitrodiphenylamine, % (nitroester stabilizer) | 0.80 | 0.68 | 0.71 | 1.74 | 1.72 | 0.68 |
| N-methyl p-nitroaniline (MNA), % (binder stabilizer) | 2.30 | 2.30 | 2.22 | — | — | 2.30 |
| 1,3-bis(N-metamethoxyphenylurethane) benzene, % (binder stabilizer) | — | — | — | 2.89 | 2.89 | — |
| Solids Description | | | | | | |
| AP to HMX ratio | 0.12 | 0.25 | 0.07 | 0.10 | 0.21 | 0.19 |
| AP size (micron/percent) | 50-20/ 79-21 | 20-5/ 30-70 | 90-50/ 50-50 | 50-20/ 50-50 | 90-50/ 50-50 | 50-5/ 36-64 |
| HMX size (micron/percent) | 57-4/ 70-30 | 20-4/ 35-65 | 57-4/ 80-20 | 58-4/ 75-25 | 58-20-4/34-33-33 | 57-4/ 38-62 |
| Aluminum size (micron) | 7 | 13 | 7 | 25 | 25 | 13 |
| Mechanical Properties (0.74 in./min./in., 77° F.) | | | | | | |
| Tensile strength ($\sigma_m$), psi | 62 | 89 | 57 | 60 | 60 | 93 |
| Elongation ($\epsilon_m$), % | 28 | 82 | 30 | 29 | 29 | 94 |
| Modulus (E), psi | 451 | 415 | 435 | 301 | 334 | 446 |
| Toughness | | | | | | |
| CIV, ft./sec.* | 290 | 610 | 320 | 300 (est) | 310 | 560 |
| Tear Strength, pli ASTM D624-73 (Die c) | 8 | 17 | 9 | — | 8 | 15 |
| 90° Peel Strength, pli ASTM D624-73 (Die c) | 2 | 10 | 5 | 3 | 3 | 8 |
| Thermal Stability | | | | | | |
| Cube Cracking** (Days 158° F., 6" Cube) | 36–46 | 98 | 32–94 | — | — | 90 (est) |
| Cube Cracking** (Days 140° F., 6" Cube) | — | — | — | 5–8 | 24–48 | — |
| Processibility | | | | | | |
| Haake Viscosity (kp @ 0.37 $sec^{-1}$ shear rate, 120° F.) | 22 | 16 | 24 | 19 | 26 | 9 |
| Pot Life (hrs. to 40 kp) | 8 | 24 | 8 | 8 | 5 | 26 |
| Ballistic Properties | | | | | | |
| Burning Rate 1000 psi (in./sec.) | 0.42 | 0.49 | 0.34 | 0.41 | 0.50 | 0.42 |
| Pressure Exponent (n) | 0.64 | 0.49 | 0.67 | 0.62 | 0.62 | 0.57 |

TABLE II (C)-continued

| PROPELLANT COMPOSITIONS AND PROPERTIES | | | | | | |
|---|---|---|---|---|---|---|
| Example No. | 2 | 3 | 4 | 5 | 6 | 7 |

*Critical impingement velocity, a measure of propellant toughness. In this test, a small sample of propellant is impacted against a steel plate by means of a shotgun. The fragmented propellant is then collected and burned in a closed bomb. The maximum pressurization rate is a measure of the degree of fracturing. The CIV is that velocity at which the pressurization rate is equal to $2.5 \times 10^6$ psi/sec.

**Cubes are placed in an oven at 158° F. and are X-rayed at regular intervals. The test is terminated when radiographs indicate void formation or cracking of the propellant sample.

The weight ratio of nitrocellulose to polyol or in the improved propellant compositions of this invention is from about 0.03/1 to about 0.8/1. For nitrocellulose having intrinsic viscosity of about 0.4 dl/gram (RS 18–25 cps) and polyglycol adipate, weight ratios of from about 0.25/1 to about 0.80/1 are preferably employed. The weight ratio of nitrocellulose to polyol can be varied depending upon the nitrocellulose and polyol selected to achieve desired properties of the propellant within the limitations of the composition formulated. Holding other propellant ingredients and concentrations constant the effects of increasing the weight ratio of nitrocellulose/polyol is to increase tensile strength and modulus of the propellant while reducing elongation. This effect is illustrated by the data set forth in Examples 8–12, Table III.

TABLE III (U)

| EFFECT OF NC/PGA RATIO ON PROPELLANT* PROPERTIES | | | | | |
|---|---|---|---|---|---|
| Example No. | NC/PGA** | Haake Viscosity (0.37 $sec^{-1}$, shear rate, 120° F.) | Mechanical Properties (0.74 in./min./in., 77° F.) | | |
| | | | σ m (psi) | ε m (%) | E (psi) |
| 8 | 0.25 | 13 | 100 | 65 | 667 |
| 9 | 0.15 | 7 | 85 | 70 | 614 |
| 10 | 0.10 | 15 | 79 | 75 | 562 |
| 11 | 0.05 | 6 | 75 | 92 | 522 |
| 12 | 0 | 8 | 40 | 155 | 374 |

*70% solids, Plasticizer/Polymer ratio = 2.16

**nitrocellulose (RS 18–25 cps - see table I); PGA is polyglycol adipate

The mechanical properties exhibited by the propellant compositions of this invention are dependent upon the plasticizer/polymer ratio. In the propellant of this invention the plasticizer/polymer ratio can vary from about 2.1/1 to about 4.5/1. In calculating these ratios the plasticizer includes the total nitrate ester plasticizer and soluble stabilizers therefor and the polymer includes nitrocellulose, polyol, binder stabilizer and diisocyanate. The effect of increasing the ratio of plasticizer to polymer is to lower tensile strength and modulus. The effect of varying the plasticizer to polymer ratio is more fully illustrated in Examples 13–22, Table IV. In these examples the diisocyanate employed was hexamethylene diisocyanate.

TABLE IV (U)

EFFECT OF PLASTICIZER/POLYMER RATIO ON PROPELLANT PROPERITES

| Example No. | Plasticizer/ Polymer | NC/ PGA | NC* Type | NCO/ OH | % Solids | Mechanical Properties (0.74 in./min./in., 77° F.) σ m (psi) | ε m (%) | E (psi) |
|---|---|---|---|---|---|---|---|---|
| 13 | 2.5 | 0.25 | AS ½ | 0.9 | 73 | 121 | 34 | 764 |
| 14 | 2.1 | 0.25 | AS ½ | 0.9 | 73 | 129 | 33 | 930 |
| 15 | 4.5 | 0.5 | AS ½ | 0.75 | 75 | 85 | 24 | 409 |
| 16 | 3.5 | 0.5 | AS ½ | 0.75 | 75 | 89 | 26 | 452 |
| 17 | 3.0 | 0.5 | AS ½ | 0.75 | 75 | 131 | 36 | 843 |
| 18 | 3.8 | 0.3 | RS 18–25 | 0.85 | 75 | 53 | 43 | 547 |
| 19 | 2.8 | 0.25 | RS 18–25 | 0.85 | 73 | 82 | 29 | 365 |
| 20 | 2.5 | 0.25 | RS 18–25 | 0.85 | 73 | 78 | 24 | 644 |
| 21 | 2.1 | 0.25 | RS 18–25 | 0.85 | 73 | 93 | 32 | 835 |
| 22 | 2.6 | 0.03 | RS 5–6 | 1.17 | 73 | 71 | 63 | 578 |

*See Table I for additional data.

The plasticizer to polymer ratio is not critical except at very high ratios i.e., above about 8/1, at which ratio syneresis or bleeding of the propellant binder occurs.

Other factors which affect the mechanical properties of propellants include the particle sizes of the various solids which are added to the propellant compositions. The effect of particle size distribution on propellant mechanical properties is illustrated by variation in the particle size of HMX employed in the propellant compositions of this invention of Example 3. The propellant of Example 3 contains 70% by weight of solids of which 40.5% is HMX. The affect of varying HMX particle size on a propellant composition similar to Example 3 in terms of mix viscosity and mechanical properties of the resulting propellant is set forth in Table V.

TABLE V (U)

EFFECT OF HMX SIZE DISTIBUTION ON PROPELLANT PROPERTIES

| HMX Size (μ) / HMX Distribution | Haake Viscosity (kp) (0.37 sec.$^{-1}$, shear rate 120° F.) | Mechanical Properties (0.74 in./min./in., 77° F.) σm (psi) | εm (%) | E (psi) |
|---|---|---|---|---|
| 10-4/25-75 | 25 | 109 | 45 | 723 |
| 10-4/50-50 | 11 | 95 | 41 | 626 |
| 57-4/15-85 | 17 | 99 | 62 | 610 |

In general it desirable to minimize the HMX particle size for maximum toughness and mechanical properties. However, a blend of varying particle sizes must be selected which gives suitable propellant mix viscosity and castability. For large motor castings it is desirable to maintain the mix viscosity of a propellant composition below 20 kp (0.37 sec.$^{-1}$ shear rate).

The ratio of NCO groups of the crosslinking agents to hydroxyl groups of nitrocellulose and polyol in the propellant compositions of this invention is from about 0.7/1 to about 1.2/1. As the ratio of NCO groups to hydroxyl groups is reduced below about 0.7 the tensile strength and the modulus of the propellant become unsatisfactory. As the NCO to hydroxyl concentration increases above about 1.2 the elongation of the propellant decreases below about 20%, i.e., to the point where it is no longer acceptable.

The curing catalysts employed in the propellant of this invention include any material that can catalyze the isocyanate hydroxyl reaction provided it is compatible with nitrate esters. Preferred catalytic materials include dibutyl tin diacetate, triphenyl bismuth, lead-2-ethylhexoate, ferric acetylacetonate, and the like. Other compounds of lead, iron or tin which are catalysts for the isocyanate hydroxyl reaction and which are compatible with nitrate esters can be employed. Dibutyl tin diacetate (DBTDA) is a particularly satisfactory curing catalyst and is employed at levels of 0.0008–0.0012% based on the weight of the propellant composition. The exact amount of curing catalyst employed in any propellant composition will depend on characteristics of the individual materials employed in the propellant and the actual composition being formulated. Dibutyl tin diacetate curing catalysts can be used at levels as low as 0.0004%. At levels higher than 0.0012% the pot life of the propellant mass becomes very short as illustrated by the data in Table VI.

TABLE VI (U)

EFFECT OF CURING CATALYST* LEVEL ON PROPELLANT** PROPERTIES

| Curing Catalyst | Propellant | Mechanical Properties (0.74 in./min./in., 77° F.) | | |
|---|---|---|---|---|
| Solids | Pot Life (hrs.) | σm (psi) | εm (%) | (psi) |
| 0.0004 | 15 | — | — | — |
| 0.0008 | 8 | — | — | — |
| 0.0012 | 5.5 | 54 | 36 | 260 |
| 0.0016 | 4 | 56 | 27 | 370 |

*dibutyl tin diacetate

Triphenyl bismuth is satisfactory for use in crosslinked double base formulations of this invention and generally provides a longer pot life than that provided by dibutyl tin diacetate. Triphenyl bismuth is usually employed in concentrations higher than that for dibutyl tin diacetate and is typically employed between 60 and 100 parts per million. At levels below 60 parts per million the propellant cures very slowly and at levels greater than 100 parts per million pot life is adversely shortened. Other curing agents such as dibutyl tin dilaurate, stannous octoate and the like can also be employed.

What we claim and desire to protect by Letters Patent is:

1. An improved crosslinked double base propellant composition, the improvement comprising a binder system consisting essentially of nitrocellulose having an intrinsic viscosity of from about 0.4 deciliters/gram to about 1.5 deciliters/gram, an aliphatic diisocyanate, a polyester polyol or polyethe polyol having a molecular weight of from about 400 to about 4000 and a hydroxyl functionality of from about 2.0 to about 2.8, energetic nitrate ester plasticizer and a binder stabilizer, wherein the ratio by weight of NCO groups of the diisocyanate to the combined hydroxyl groups of the nitrocellulose and the polyol is from about 0.7/1.0 to about 1.2/1.0, the ratio by weight of the stabilized energetic nitrate ester plasticizer to the combined weight of nitrocellulose, polyol, binder stabilizer and diisocyanate is from about 2.1/1.0 to about 4.5/1.0, and the ratio by weight 0f nitrocellulose to polyol is from about 0.03/1 to 0.8/1, said binder system containing from about 1.3% to about 4.3% by weight of a binder stabilizer, said nitrate ester plasticizer comprising from about 68% to about 82% by weight of the binder system and said binder system comprising from about 23% to about 30% by weight of the propellant composition.

2. The improved crosslinked double base propellant composition of claim 1 in which the binder stabilizer is selected from the group consisting of N-methyl-p-nitroaniline (MNA); N-isopropyl-p-nitroaniline; N-(2-acetoxyethyl)-p-nitroaniline; N-(2-methoxyethyl)-p-nitroaniline; and N-(2, 2-dimethoxyethyl)-pnitroaniline.

3. The improved crosslinked double base propellant of claim 2 in which the diisocyanate is hexamethylene diisocyanate.

4. The improved crosslinked double base propellant of claims 1, 2 or 3 in which a polyester polyol is employed, said polyester polyol being polyglycol adipate having a molecular weight range of from about 2000 to 3000.

5. The improved crosslinked double base propellant of claims 1, 2 or 3 wherein the energetic nitrate ester plasticizer is nitroglycerin.

6. The improved crosslinked double base propellant of claims 1, 2, or 3 wherein the low molecular weight nitrocellulose has a viscosity of about 0.4 deciliters/gram.

7. The improved crosslinked double base propellant composition of claims 1, 2 or 3 in which the binder stabilizer is N-methyl-p-nitroaniline.

* * * * *